US007926408B1

(12) United States Patent
Kley

(10) Patent No.: US 7,926,408 B1
(45) Date of Patent: Apr. 19, 2011

(54) VELOCITY, INTERNAL BALLISTICS AND EXTERNAL BALLISTICS DETECTION AND CONTROL FOR PROJECTILE DEVICES AND A REDUCTION IN DEVICE RELATED POLLUTION

(75) Inventor: Victor B. Kley, Berkeley, CA (US)

(73) Assignee: Metadigm LLC, Berkeley, CA (US)

( * ) Notice: Subject to any disclaimer, the term of this patent is extended or adjusted under 35 U.S.C. 154(b) by 0 days.

(21) Appl. No.: 11/564,133

(22) Filed: Nov. 28, 2006

Related U.S. Application Data

(60) Provisional application No. 60/740,586, filed on Nov. 28, 2005.

(51) Int. Cl.
*F41G 1/00* (2006.01)

(52) U.S. Cl. ..... 89/41.17; 89/41.16; 124/73

(58) Field of Classification Search ..... 434/20, 434/21; 124/73; 235/411, 412, 413; 42/84; 89/41.17, 41.16
See application file for complete search history.

(56) References Cited

U.S. PATENT DOCUMENTS

| | | | | | |
|---|---|---|---|---|---|
| 4,624,641 | A * | 11/1986 | Gallagher | ..... | 434/21 |
| 4,948,371 | A * | 8/1990 | Hall | ..... | 434/21 |
| 5,060,391 | A * | 10/1991 | Cameron et al. | ..... | 42/115 |
| 5,215,465 | A * | 6/1993 | Marshall et al. | ..... | 434/22 |
| 5,476,385 | A * | 12/1995 | Parikh et al. | ..... | 434/22 |
| 5,551,876 | A * | 9/1996 | Koresawa et al. | ..... | 434/16 |
| 5,614,942 | A * | 3/1997 | Rom | ..... | 348/61 |
| 6,663,391 | B1 * | 12/2003 | Otowa | ..... | 434/16 |
| 6,887,079 | B1 * | 5/2005 | Robertsson et al. | ..... | 434/22 |
| 6,942,486 | B2 * | 9/2005 | Lvovskiy | ..... | 434/16 |
| 6,966,775 | B1 * | 11/2005 | Kendir et al. | ..... | 434/19 |
| 7,363,742 | B2 * | 4/2008 | Nerheim | ..... | 42/146 |
| 2004/0146840 | A1 * | 7/2004 | Hoover et al. | ..... | 434/21 |
| 2006/0048432 | A1 * | 3/2006 | Staley, III | ..... | 42/122 |
| 2006/0152786 | A1 * | 7/2006 | Takakuwa et al. | ..... | 359/200 |
| 2007/0009860 | A1 * | 1/2007 | Young | ..... | 434/21 |
| 2007/0044365 | A1 * | 3/2007 | Deken | ..... | 42/146 |
| 2007/0077539 | A1 * | 4/2007 | Tzidon et al. | ..... | 434/21 |
| 2007/0190495 | A1 * | 8/2007 | Kendir et al. | ..... | 434/21 |
| 2007/0238073 | A1 * | 10/2007 | Portoghese et al. | ..... | 434/21 |

* cited by examiner

*Primary Examiner* — Stephen M Johnson
*Assistant Examiner* — Daniel J Troy
(74) *Attorney, Agent, or Firm* — Kilpatrick Townsend and Stockton LLP

(57) ABSTRACT

Improvements to projectile devices (particularly air guns) include techniques for measuring and controlling the velocity of projectiles in the barrel and after leaving the barrel, allowing the use of non-toxic projectiles. Tracking of a projectile's flight by its unique sound and/or its unique electromagnetic signal or signal modulation are also provided, along with after-barrel guidance that can be used to improve accuracy. Control for discriminating between authorized and unauthorized users is also provided. A projectile device can also be used for inexpensive and harmless practice using optical and/or acoustic information gathered by targeting and imaging systems built into the device.

16 Claims, 14 Drawing Sheets

VELOCITY, INTERNAL BALLISTICS AND EXTERNAL BALLISTICS DETECTION AND CONTROL FOR PROJECTILE DEVICES AND A REDUCTION IN DEVICE RELATED POLLUTION

CROSS-REFERENCES TO RELATED APPLICATIONS

This application claims the benefit of U.S. Provisional Application No. 60/740,586, filed Nov. 28, 2005, entitled "Velocity, Internal Ballistics and External Ballistics Detection and Control for Projectile Devices and a Reduction in Device Related Pollution," which disclosure, including any attachments and appendices thereto, is incorporated herein by reference for all purposes.

BACKGROUND OF THE INVENTION

The present invention relates generally to projectile devices such as air guns and in particular to velocity, internal ballistics and external ballistics detection and control for projectile devices and a reduction in device related pollution.

In general it is desirable to build air guns which use pressure chambers to contain a suitable gas such as CDA, Nitrogen, or Argon. Such air guns also pollute the environment with toxic lead as lead-based projectiles are commonly used. Less toxic or non-toxic alternative projectiles are known, but they generally suffer disadvantages in striking power and accuracy at long range.

Thus, it would be desirable to provide an air gun capable of using alternative projectiles with improved striking power and accuracy.

SUMMARY OF THE INVENTION

Some aspects of the present invention relate generally to techniques for measuring the velocity of air gun projectiles in the barrel and after leaving the barrel of a typical air gun or firearm. In general it is desirable to build air guns which use pressure chambers to contain a suitable gas such as CDA, Nitrogen, or Argon. Such air guns also pollute the environment with toxic lead. One objective of this invention is the elimination of any health, EPA or other government based concerns and those of parents and loved ones. It is also an objective to provide a safe non-toxic projectile that can be used with conventional firearms without sacrificing striking power and accuracy at long range, in contrast to other non-toxic bullets. It is yet another objective for this invention to boost the velocity of any safe projectile by extending the time of the principal gas release or by gas release as the projectile proceeds down the barrel and enters external flight. It is yet another object of this device to track the projectile in external flight by its unique sound and by its unique electromagnetic signal or signal modulation. It is a further object of this invention to provide after-barrel projectile guidance to improve the accuracy of the air gun or projectile device. It is yet another object of this invention to provide a means to cause the projectile to change its shape and/or direction in flight to protect external things and beings from damage. It is a further purpose of this invention to provide a very safe personalized control for discriminating between authorized and unauthorized users. It is also an object of this invention to provide a means whereby inexpensive and harmless practice may be made with the same gun that with control, and/or gas composition and/or special active projectile use can become suitable for defense purposes as an effective weapon. It is yet another object of this invention to provide a compact and more useful means for target acquisition then presently available. Further this invention includes means for making partial use of the ideas in components compatible with existing production air guns.

The present invention relates more specifically to techniques for building projectile weapons particularly useful with but not restricted to those weapons presently classified as air guns.

A further understanding of the nature and advantages of the present invention may be realized by reference to the remaining portions of the specification and the drawings. It is to be understood that the advantages described herein pertain to specific embodiments and that alternative embodiments might provide fewer than all of these advantages.

DESCRIPTION OF SPECIFIC EMBODIMENTS

Figure 1:
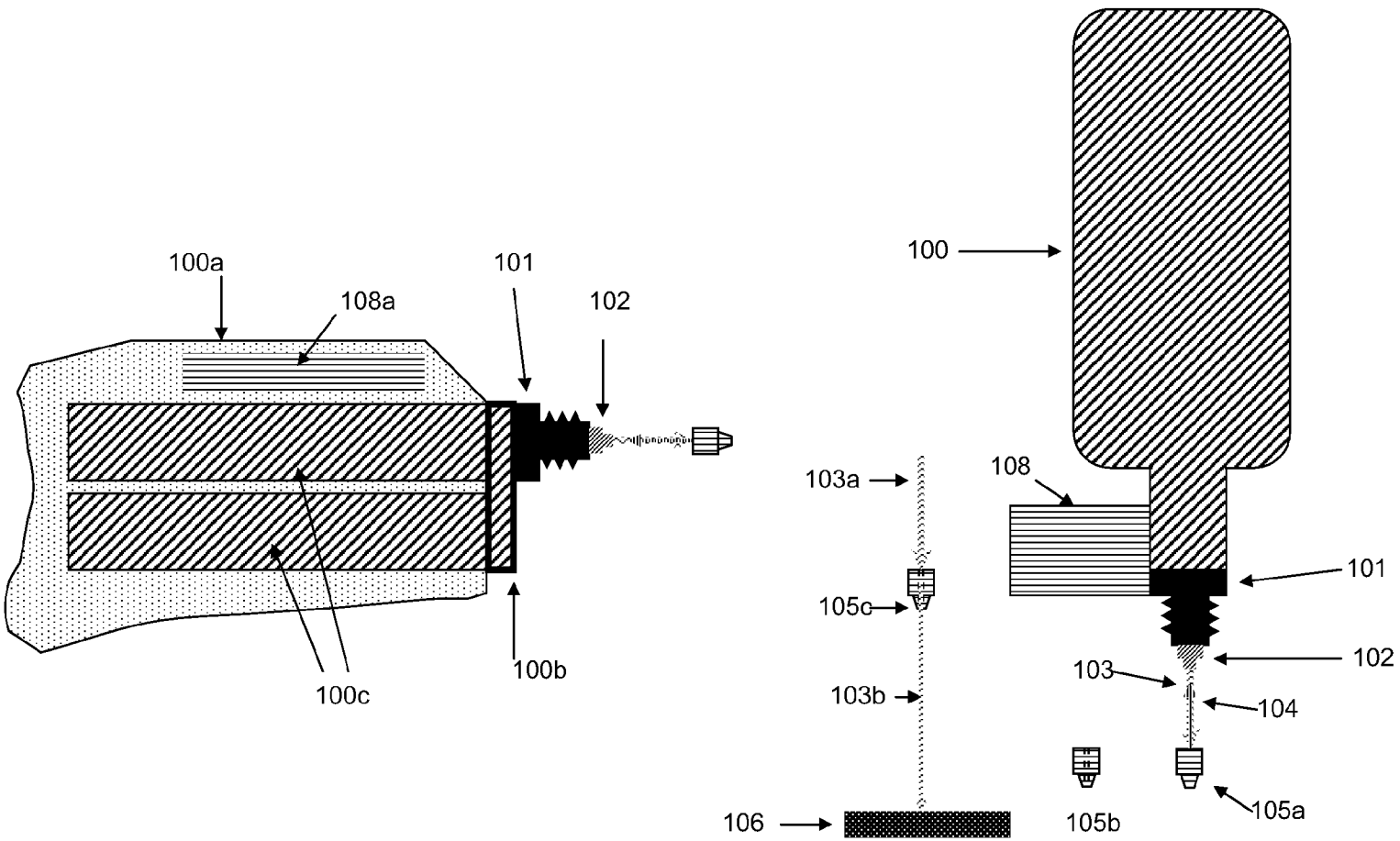
FIG. 1 shows a commonly available pressure tank used with air rifles and particularly the AirForce™ line of air rifles.

In an embodiment of the attachment to an existing and currently manufactured air gun product series as in FIG. 1, the normally detachable pressured gas cylinder is removed and a new cylinder assembly 100 or 100*a* is threaded in its place. (Assembly 100*a* uses two cylinders 100*c* connected by a tube or manifold 100*b*.) The new assembly includes a threaded sleeve 101 and a mechanical and piezoelectric gas control valve 102. The valve assembly also includes a laser source producing laser beam 103 which is coaxial with the center line of the bore of the air gun's barrel. In operation the same trigger and firing mechanism is used in this attachment embodiment as in the standard air gun. Gas control valve 102 includes sensors monitored by the control and display assembly 108 or 108*a*. After sensing (by the induced voltage) of the firing hammer blow, the system continues to hold the gas valve open such that the gas pressure in the arm between the gas bottle and the chamber/rifle barrel from behind the projectile is kept at a pre-selected or preprogrammed level. Alternatively controller 108 may be used to monitor the return or reflected laser light 104 and to determine, by use of well known LIDAR techniques, the projectile's instantaneous velocity as it proceeds down the barrel. The controller can then increase or decrease the rate of gas transfer through the piezoelectric valve until the projectile has left the barrel. This process can therefore be used to dynamically correct and maintain any given group of projectiles at a pre-selected precise velocity. Controller 108 or 108*a* can also report the internal ballistics and pressures within the weapon and provide a user control means for changing the pressures, projectile velocities, or max internal pressures as he sees fit. Additionally this embodiment includes the use of simple projectiles 105*a*, or a projectile 105*b*, which has a transparent insert, or a projectile 105*c*, which has a through hole along its central axis. Such latter elements permit a portion of the collimated laser beam to pass down the length of the bore and at all times (with or without a projectile in place) coaxially illuminate the target in a manner which is guaranteed to be co-linear with the projectile. Further an outer shell of laser or light emitting diode light either from an additional source (103*a*) or from the same source can be used to detect whether a projectile is in the weapon and/or initiate a chemical reaction with some active material on or in the projectile. So this coaxial laser (s) can be used to acquire targets, and for practice alignment when no projectile is actually released from the arm.

Figure 2:
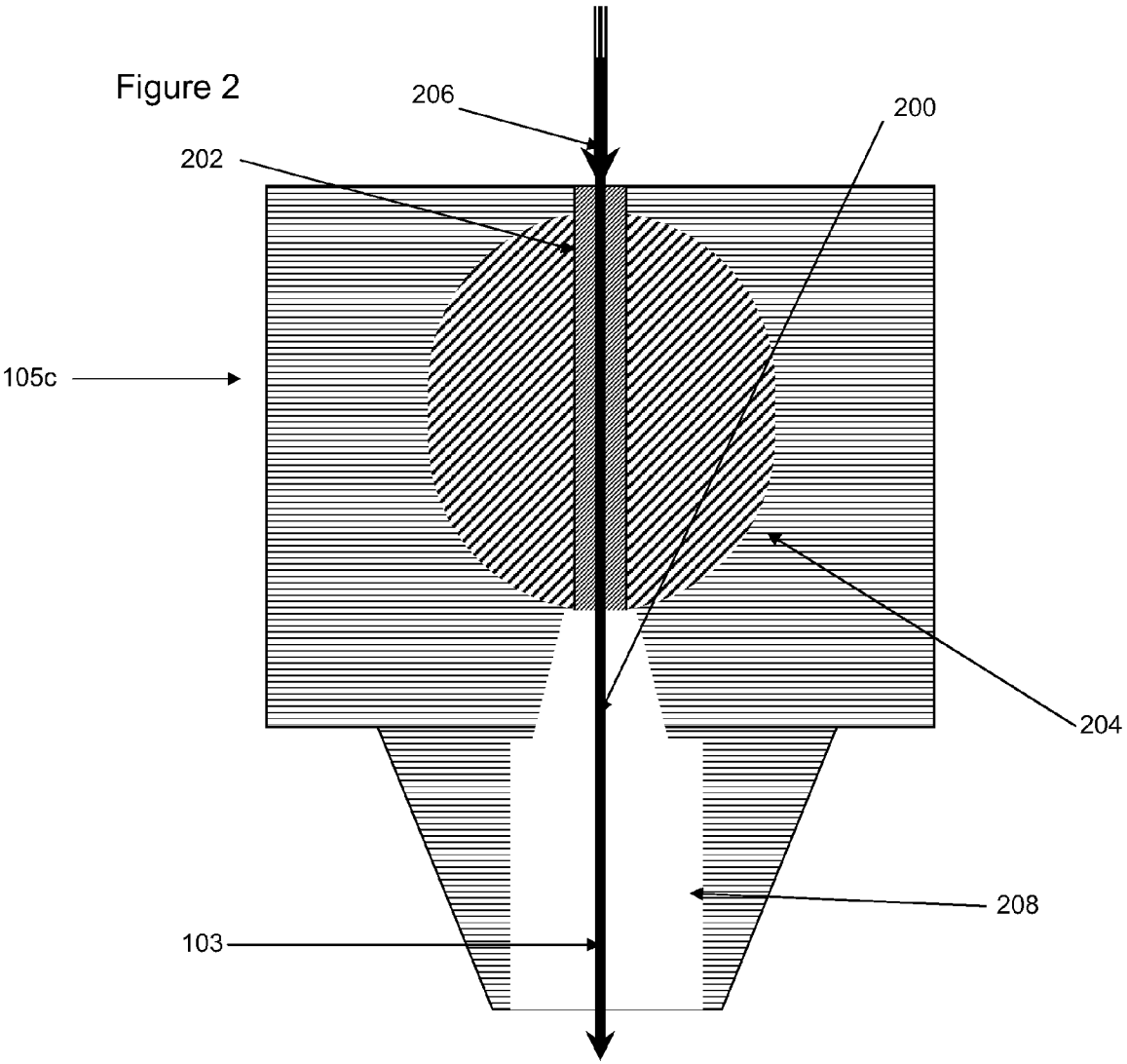
FIG. 2 shows a side cross section of one of the projectiles.

In FIG. 2 the projectile 105*c* is shown. Therein, the projectile can be seen to include an igniter 202, a fuel chamber 204, and hollow point air ram 208. In operation a highly oxidizing gas such as high pressure pure oxygen is introduced. Either as a result of the application of light beam 206 (which may be a deep UV, UV, visible or infrared source from a light emitting diode or laser diode or other source) or from just the presence of high pressure $O_2$, or ozone created by a UV exposure and/or cold cathode electric discharge, or by direct electric discharge on the igniter, the fuel ignites and burns during the projectile's internal transit or (preferably) just after the projectile leaves the barrel. As the igniter burns it permits more air to be rammed down the length of the projectile and such compressed ram air along with the heat of the igniter causes the fuel 204 to begin its burn producing ramjet thrust on the projectile. Thus, this design can produce a system in which the projectile leaves at a low velocity from the air gun and then accelerates to much higher velocity during its external flight.

In yet another embodiment the projectile 802 may be made such as to be reusable by incorporating replaceable rifling or (for the hexagon barrel) sealing means 800. Furthermore various kinds of caps, heads or internal structures may be included to provide a broad head arrow (FIGS. 8 and 9*a,b*) or an electrical storage and electrode means to deliver one or more high voltage shocks to the target, or a hypodermic structure to deliver medicine, or any other chemical agent desirable to inject into the target.

Figure 3:
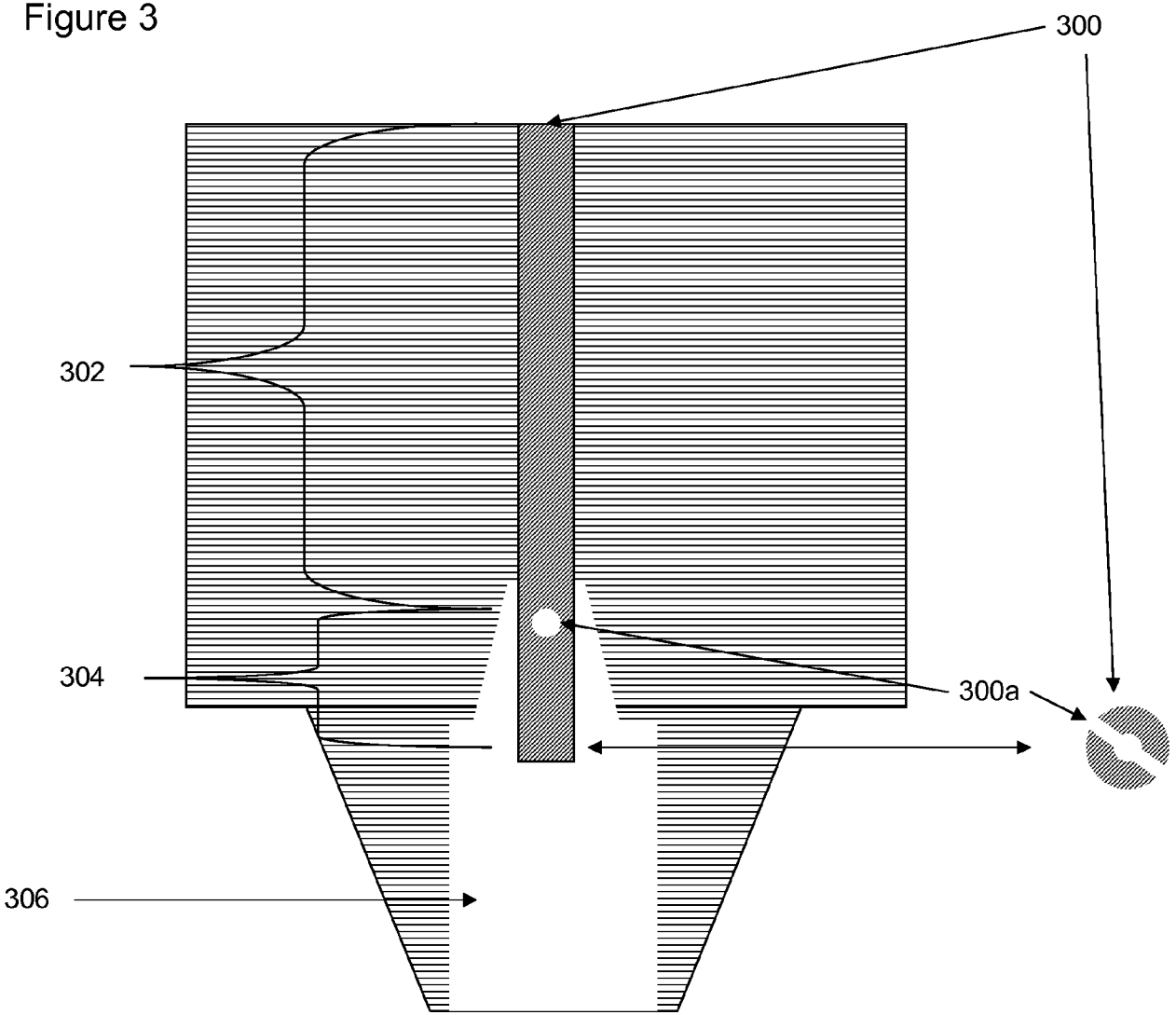
FIG. 3 is a side cross section of a projectile variation.

In an alternative embodiment, shown in FIG. 3, a hollow tube 300 is introduced. This tube has a cross hole 300*a* near the bottom of the hollow point 306. When in the barrel and immediately when the pressure is applied to the base of the projectile the working gas causes a whistling through the hole (said sound may be in the ultra-sonic range and may be tuned intentionally to be either out of perception or for the perception of any given game or non-game animal including humans). The wavelength of such a sound depends on the length and diameter of the hole size and whistle bore size and length 302, and this sound may be monitored by controller 108 through the direct conduction of the sound up the barrel and frame of the air gun to a sensor in the controller package 108. This sound will change and have a particular wavelength based on the Doppler effect as the projectile accelerates down the barrel. Thus, this Doppler wavelength profile is yet another means by which the internal ballistics may be known to the controller 108 or any external reader or user. Said information as above can then be used to control the projectile velocity by applying or removing pressure in the barrel. After leaving the end of the barrel, air compressed at the front of projectile predominates the air flow through the whistle, which is now entirely reversed and whose wavelength now depends on length 304, thus producing a different sound for monitoring the external ballistics, which may also be detected by the controller 108 through an external microphone such as 1208 and displayed for user benefit or used in part to control an active projectile via steering and the application of rocket or ramjet fuel to the projectile motor.

Figure 4:
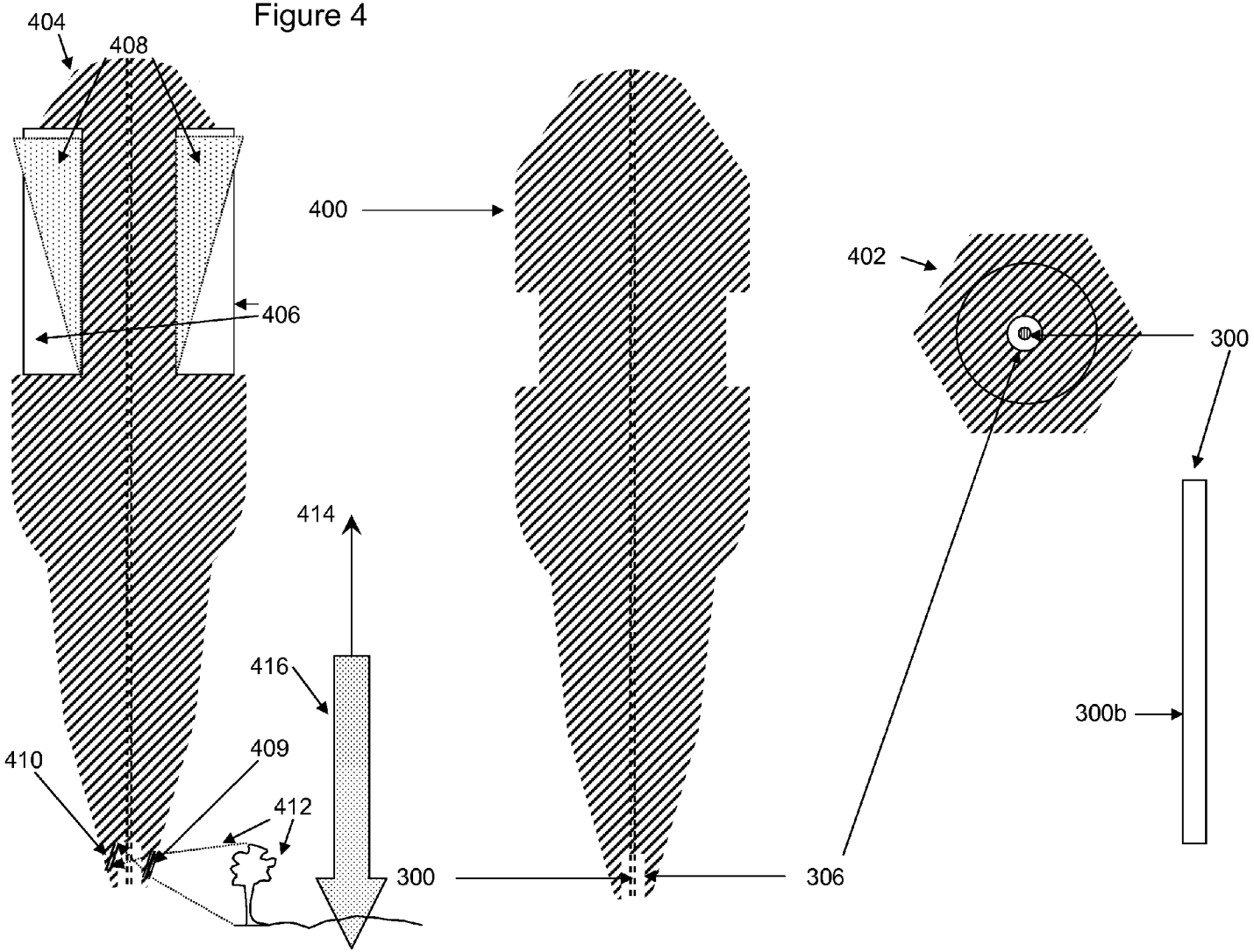
FIG. 4 is a side cross section view showing two other projectile variations and a special weapon type.

Yet another alternative embodiment the of the projectile and barrel is shown in FIG. 4. The region 400 affixed to the projectile may be any low friction material such as PTFE (Teflon), diamond film, or other well known lubricant forming one or more spin-up rings along the length of the projectile. These rings are a good sliding fit or interference fit with the barrel which has six hexagonal grooves twisting to the right or left to spin-stabilize the projectile or conventional rifling with a round cylindrical PTFE (or other engineering plastics such as polyamides) such that the rifling can deform same and spin up the projectile. Alternatively in projectile 404, the projectile is divided into two sections with cylinder 406 free and uncoupled to the body 404, which is being spun up by the rifling or hexagonal twist. The barrel interior may be coated with chromium, diamond, or other low-friction, long-wearing material. Further cylinder 406 has electromechanical or mechanical means for deploying steering winglets (3 or 4 or more) 408 which can stabilize and/or steer the projectile while the balance of the projectile is still spinning. Tracking and detector means may then be incorporated into projectile including a line lens 409 and line camera 410 sensitive to one or more of visible, UV, or infrared electromagnetic radiation and forming as the projectile spins a line image of the surroundings 412 in the direction of the projectile's path. Such an image system can be used for targeting or to create a survey of surroundings in any direction within the range of the projectile. Such a projectile may also include a ramjet compartment as taught herein to extend its flight and may be made of very light materials since it would not be dependent necessarily on the momentum of the projectile for accurate placement but could be dynamically steered (from the on board camera and/or from a guiding observer or automatic system). Using projectile type 404 or a variation thereof, an entire remote control (e.g., using RF or laser communications) launcher with propellant tank and projectiles could be dropped from high altitude to land and assume a more or less vertical position as shown by such a device 416 in FIG. 4. A launched projectile 414 could then achieve a high altitude on ramjet boost and remain circling in the vicinity for an extended period. A variation of projectile 404 can be made with a very thin light casing and a maximum of fuel to both seek a high altitude and provide minimal load on the extended winglets to sustain long glide times and distances.

Figure 6:
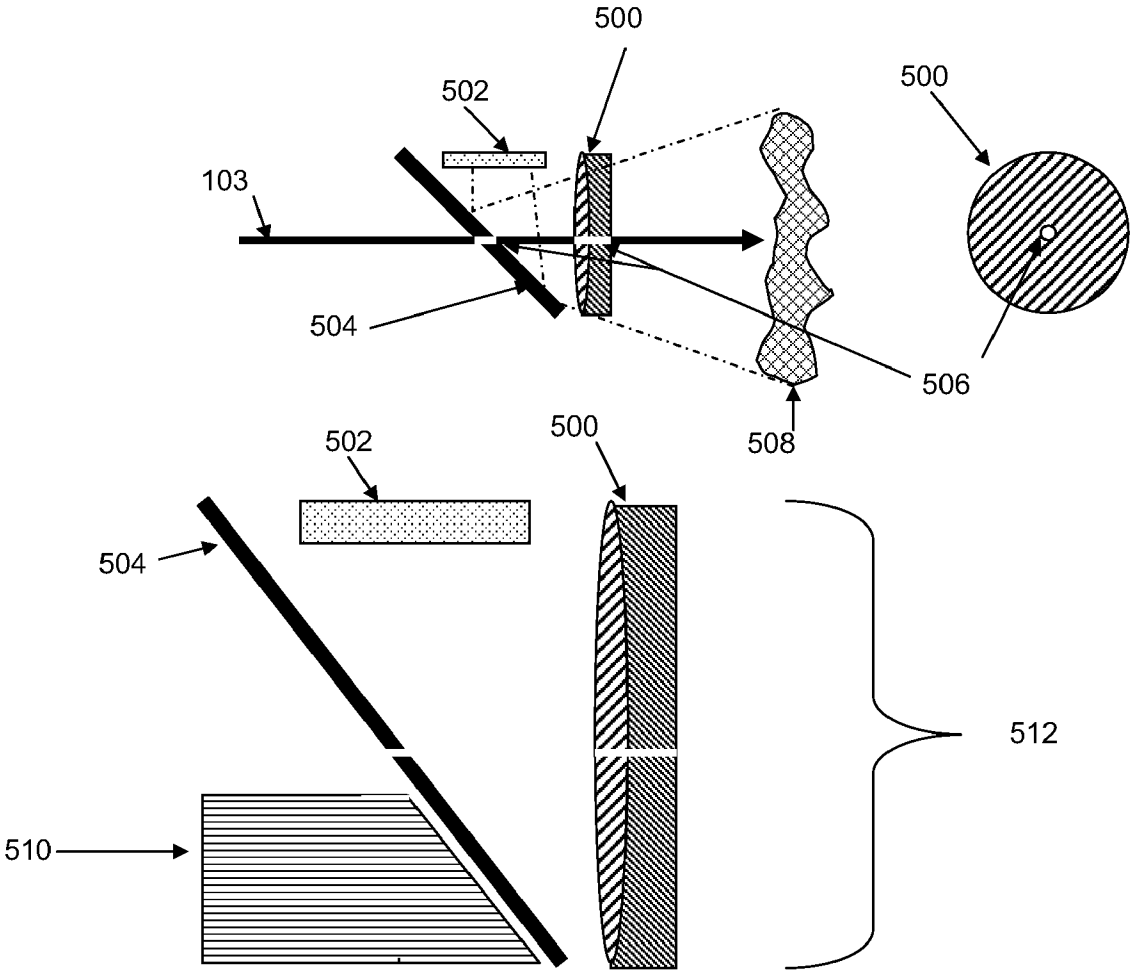
FIG. 6 shows a cross section view of an imaging system coaxial with the projectile barrel.
Figure 11A:
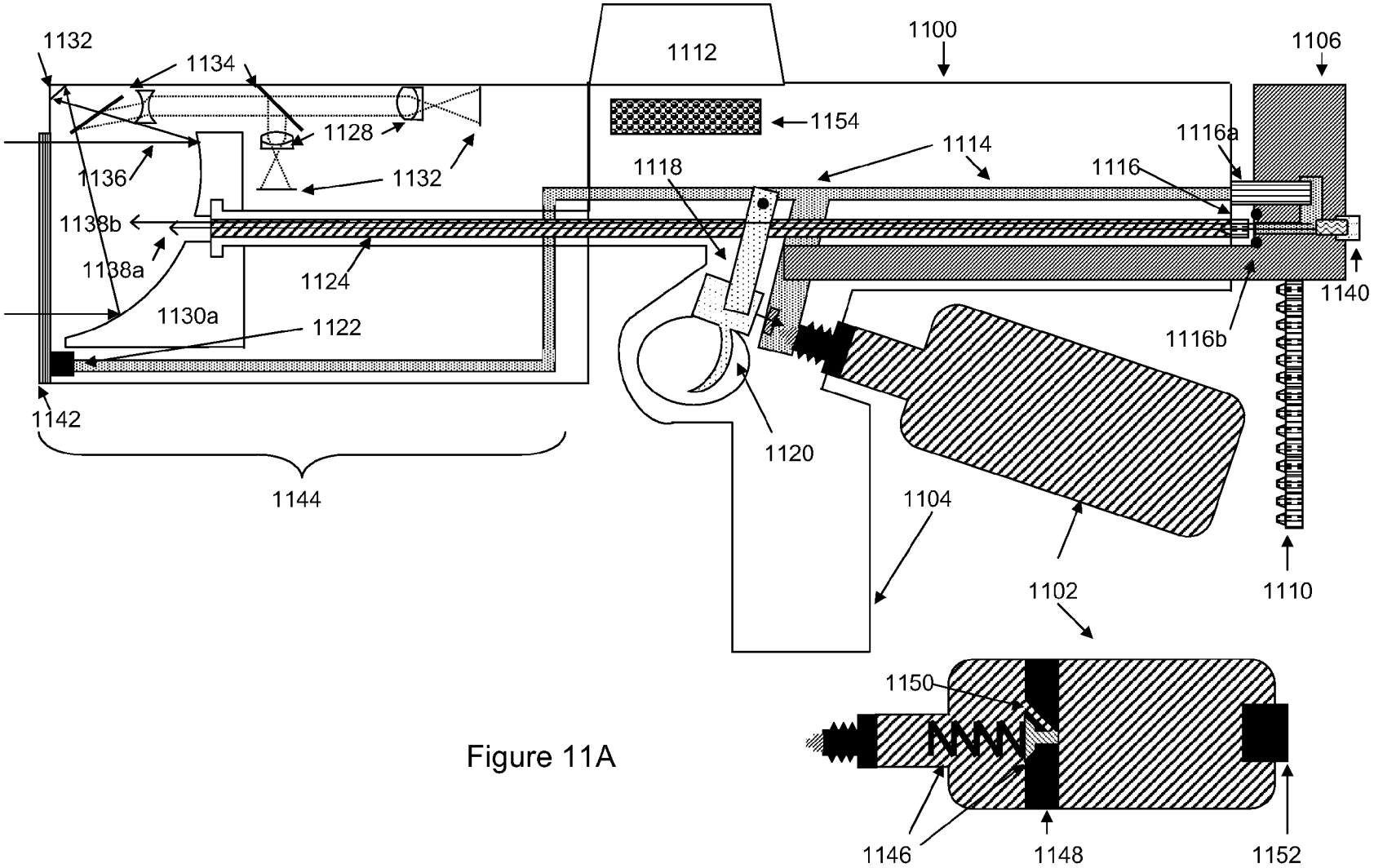
FIGS. 11A-11D show a side cross section plane view (FIG. 11A) and three frontal views (FIGS. 11B-11D) of the preferred embodiment including the flattened optics, simple front surface integrated reflector, body rotation and two chambered regulated gas source reservoir.

As shown in FIG. 6 a video camera assembly 512 including video camera 502 with reflector 504 and lens assembly 500 may be made so as to be coaxial with the barrel such that the projectile (e.g., projectile 105*c* of FIG. 1) may pass through the lens and reflector components harmlessly. In addition the targeting laser (e.g., beams 1138*a*, 1138*b* as shown in FIG. 11A) may also pass through the same aperture 506 in the lens 500 and reflector 504. Element 510 is the camera controller to grab and exchange the image via a wireless connection or by USB2 or other wired connections. Further the main controller 1154 (shown in FIG. 11A) can also be connected wirelessly or by wire to local or remote trigger and/or targeting systems. In one embodiment the trigger may be associated with a specific acquired image including an associated mark or cross hair carried digitally on the real image. The trigger then can be set to fire whenever the overlaid crosshair or mark is coincident with the real image thus electronically compensating for an unsteady hand or aim. Indeed multiple acquired images may be so set up and the weapon set up under program control to fire on alignment to said target 508, when aimed carefully or swept across the target field.

Figure 5:
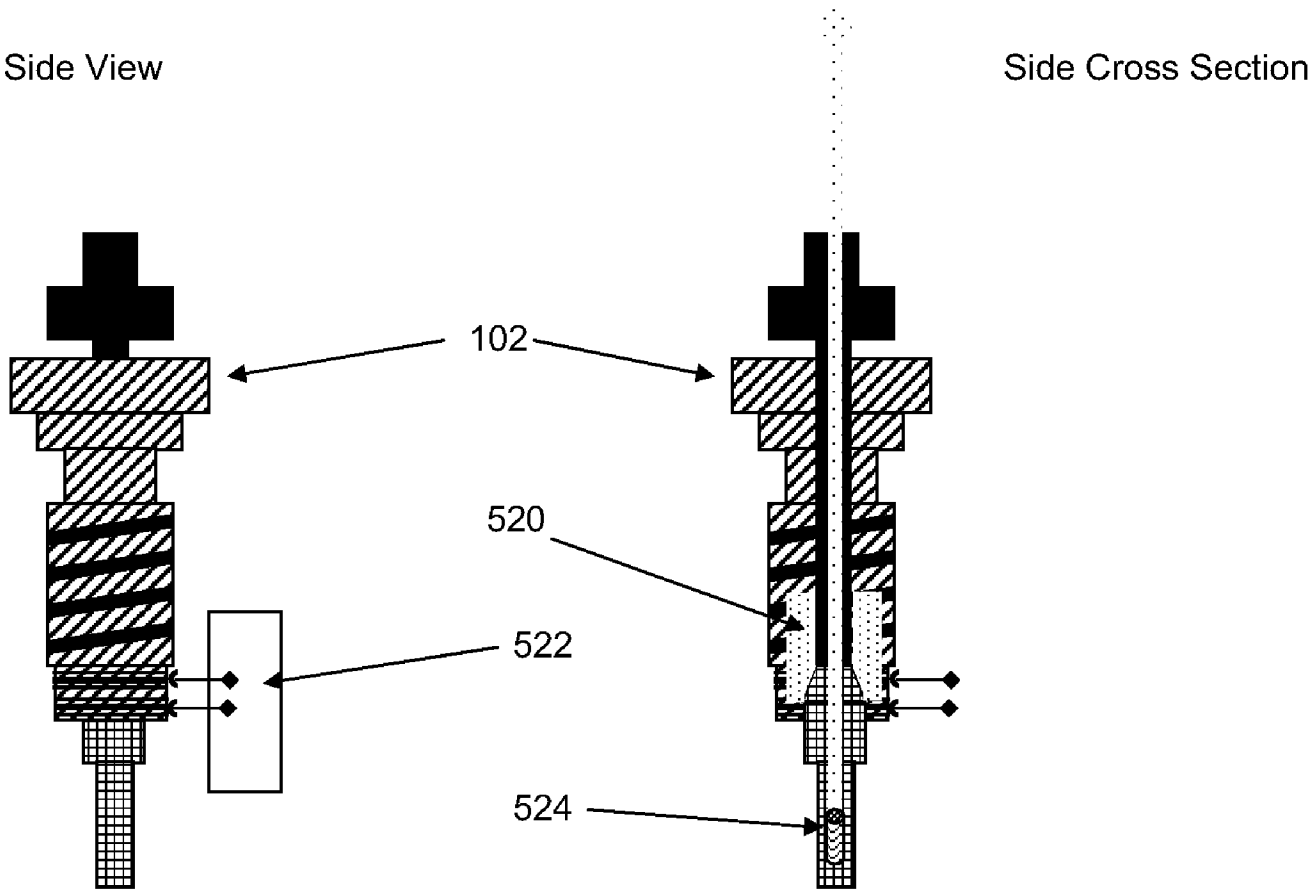
FIG. 5 shows detailed cross sections of a air control valve for the weapon.

FIG. 5 shows details of the piezoelectric/mechanical control valve 102 with piezoelectric element 520, electrical connections 522 and laser diode and collimating lens 524.

Figure 7:
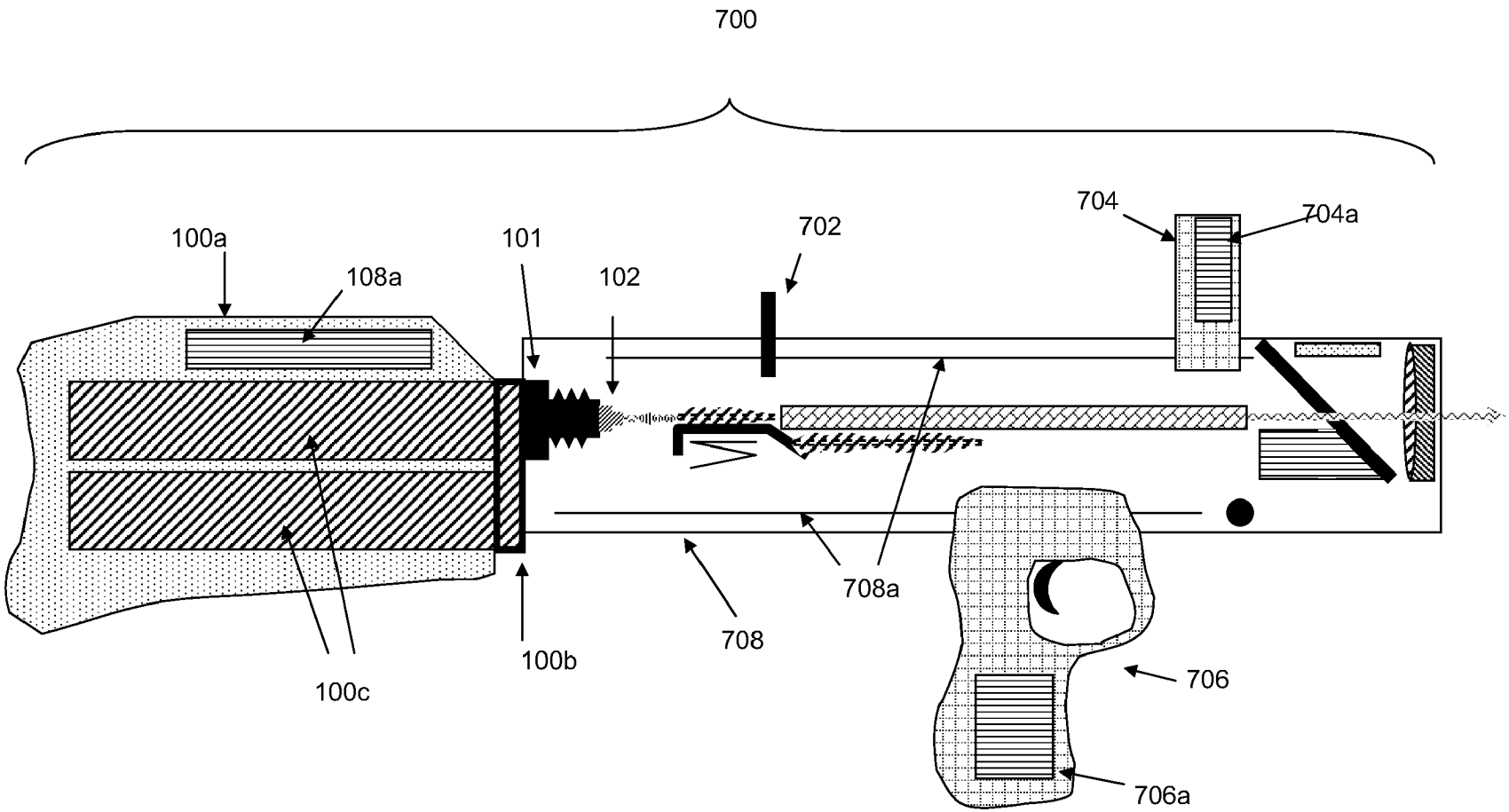
FIG. 7 shows a complete weapon using the components from 1-6 and some additional elements.

As can be seen in FIG. 7, the components described above (including assembly 100 or 100*a*) can be combined on rails 708, 708*a* along with a wireless trigger assembly 706 to form a complete air rifle 700. This departs from the simple add-ins in particular because it has no mechanical linkage to the trigger at all. All firing is controlled by the controller 108*a*, which communicates with the communicating elements including camera controller 510, display controller (sight 702, 704, 704*a*) and trigger controller 706*a*. The operation may be wired or wireless. Wireless operation permits shared monitoring of the sight picture and trigger squeeze for training and practice purposes.

Figure 8:
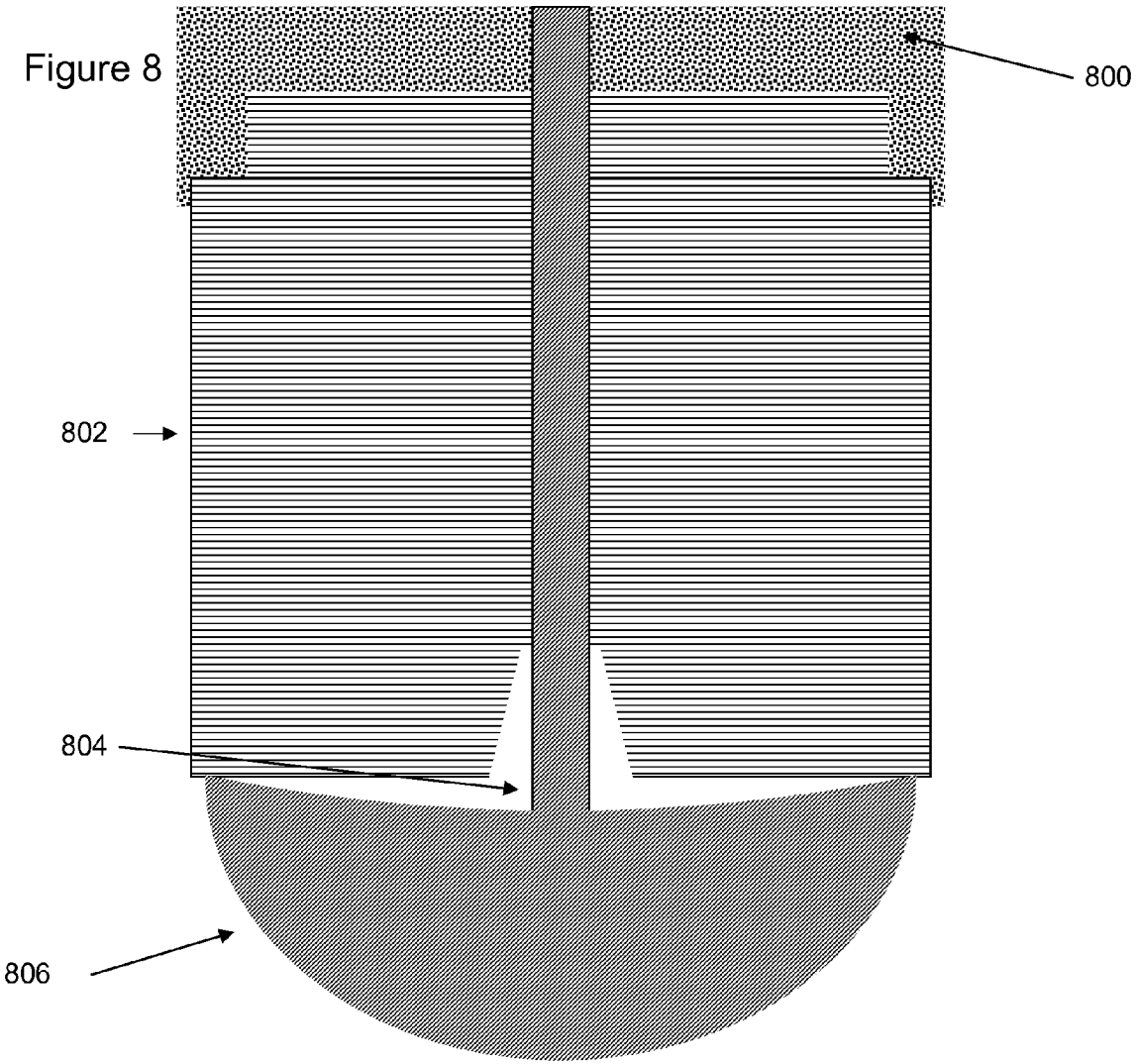
FIG. 8 shows a lead-free projectile which is reusable.

In FIG. 8 a reusable projectile 802 is shown with replaceable rifling engaging means 800 made of acetal, polypropylene, Teflon, paper, wax, leather or other suitable material. The replaceable member 800 is pressed onto the base of the projectile 802 or threaded or pressed onto a through shaft 804 that is attached to or integral with the replaceable cap element 806. The projectile 802 may be made from brass, bronze, copper, bismuth, copper coated steel, iron, copper coated iron, tungsten, ferro-tungsten, osmium, rhenium, tantalum, iridium, platinum, neptunium, gold, uranium, hafnium, protactinium, neptunium, berkelium, californium, rhodium, silver, ruthenium, molybdenum, palladium, injection moldable tungsten powder loaded plastic, Hevi-Shot (an alloy of tungsten, iron and nickel) or other suitable material. Dr. Darryl Amick, a metallurgist, developed Hevi•Shot™ in 1998. The product is made with tungsten alloy, nickel and iron to a density of 12 grams per cubic centimeter.

Figures 9A, 9B:
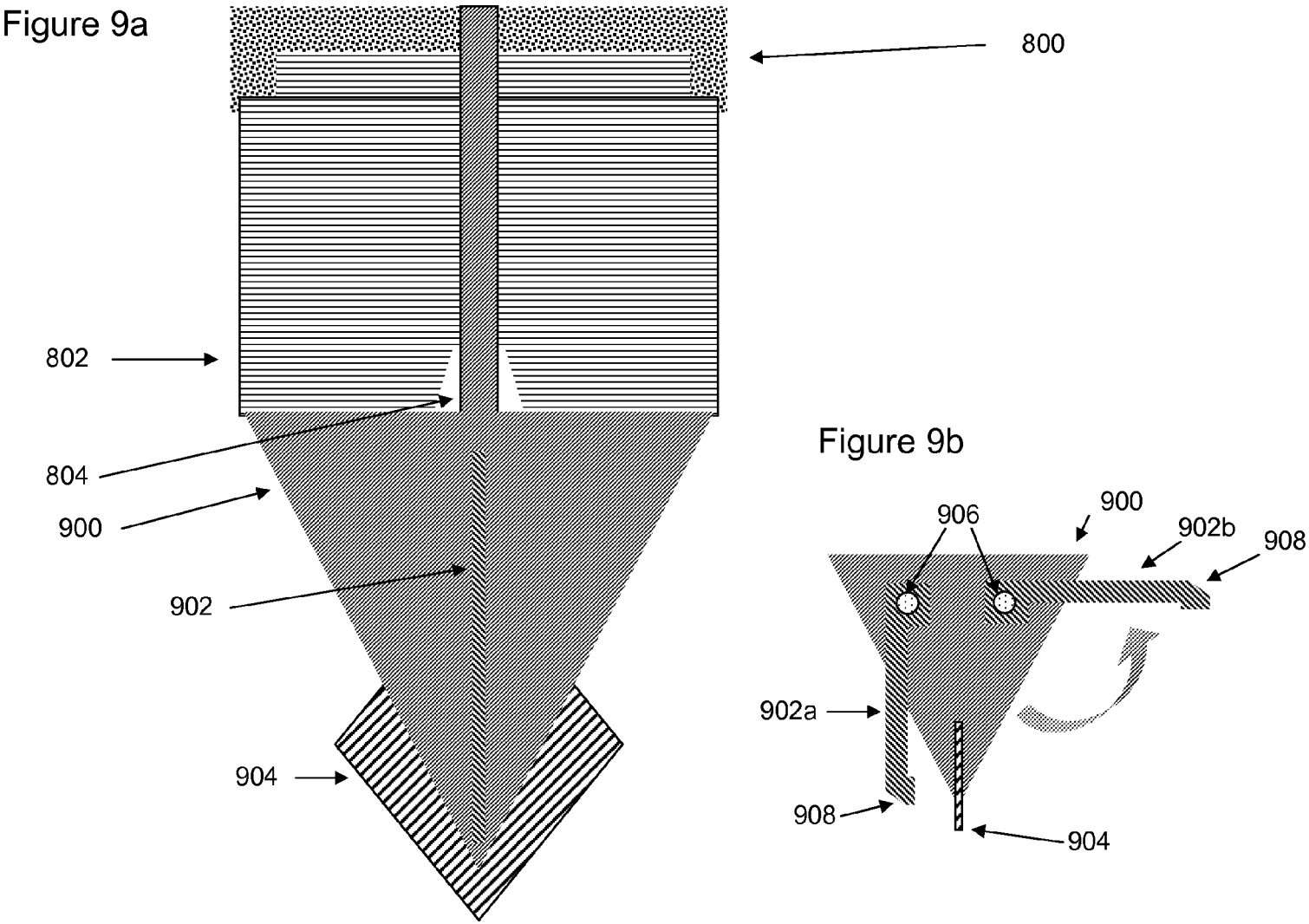
FIGS. 9*a*-9*b* show a lead-free projectile with extensible cutting arms and an arrow head blade for use in hunting big game.

In FIG. 9*a* a special cap 900 assembly similar in action to a hunting arrow tip is incorporated into the cap. A broad head razor tip 904 is shown in this cross section plane view with the orthogonal extendable arms 902 seen edge on. The broad head assembly is similar to and may be made by means well known in the hunting arrow industry.

In FIG. 9*b* special cap 900 is viewed in a cross section plane view after rotation from the view of 9*a* by 90 degrees around the projectile central traveling axis. As shown, one arm 902*a* is retracted as it would be traveling down the air gun barrel, while the other 902*b* is extended fully around pin 906 and acts to resist removal from the game animal helping to quickly bleed out and kill the animal.

Figure 10:
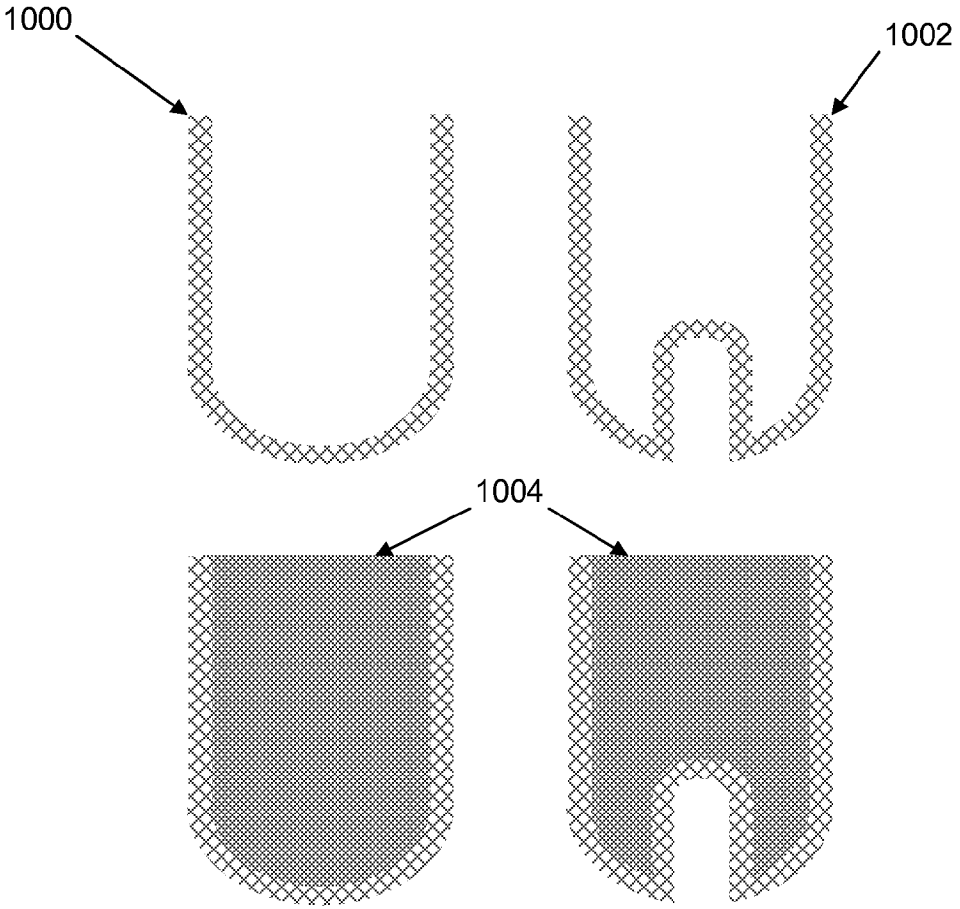
FIG. 10 shows a side cutoff view of a projectile or bullet created by filling a shell of polypropylene, polyethylene, PTFE (Teflon), a plastic base material with some or major amount of PTFE in the mixture of the shell. The shell is then filled with one or more pours of mixtures of Hevi-Shot of one or more shot sizes, or similar granulated material made form other high density metals such as tungsten, osmium, rhenium, tantalum, lead etc. Alternately a solid cylinder or tube of any of tungsten, osmium, rhenium, tantalum or lead can be constructed instead of the filler.

FIG. 10 shows four side cross sections of two projectile types 1000 and 1002, which may or may not be reusable and may be used in general for any purpose present air gun and firearm projectiles are used. In each projectile 1000 and 1002, a respective shell formed by casting, injection molding, or machine processes or any combination thereof is then filled with a mixture of Hevi-Shot™ (tungsten, iron, nickel spheres) and some binder such as acrylic casting plastic, urethane resin, epoxy, concrete, plaster, water and wheat or rice flower paste, explosive such as C-4 or other binding agent forming filler 1004. The sphere size may be varied or various filling agents may be combined. For example a series of large spheres (double 0 buck shot) may be placed in the nose (downward end) of the projectile in combination with a C-4 explosive binder. A contact initiator is inserted through the wall of the central hole in 1002, and the balance of the shell 1002 is filled with fine Hevi-Shot (7 or 9 sphere size) and an epoxy binder. This latter assembly would then explode on contact with the target, driving the buckshot in a forward spreading pattern through the target; for most animals shot anywhere in the central torso, the projectile would be instantly deadly. Alternatively the buckshot can be placed with a light flour/water binder so that just the force of the impact will permit the shot to travel forward through the outer shells (1000, 1002) to further penetrate the target. The outer shells 1000 and 1002 may be weakened by intentional thinning along the walls to permit the projectile to open up or expand on encountering the target.

Figure 11D:
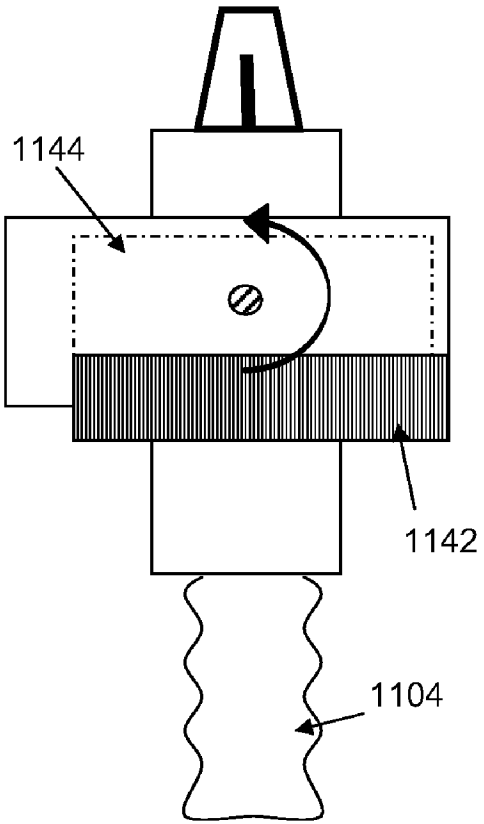
Figure 11C:
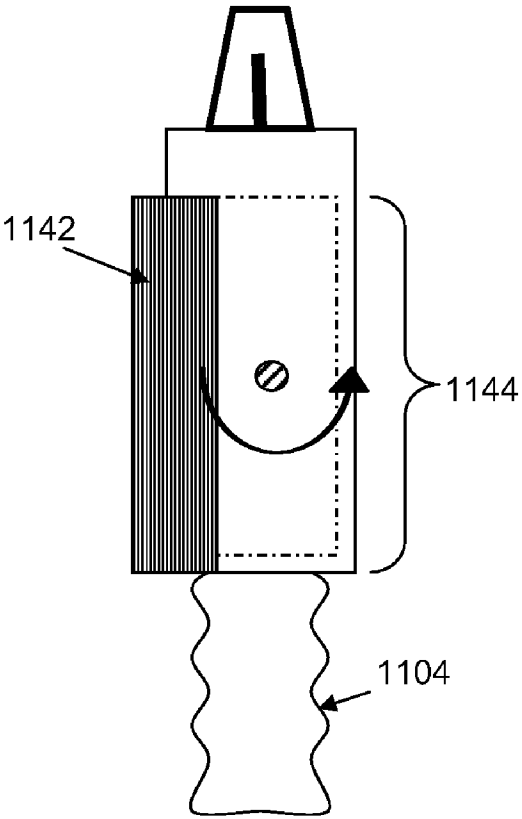
Figure 11B:
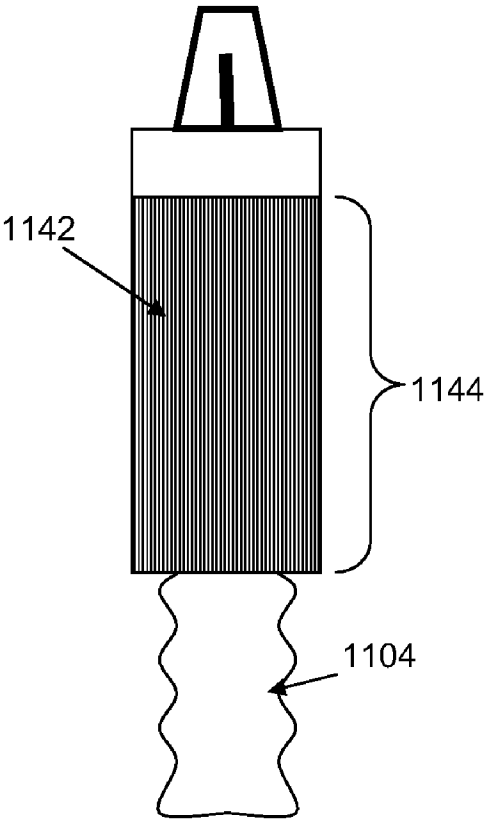
Figure 12:
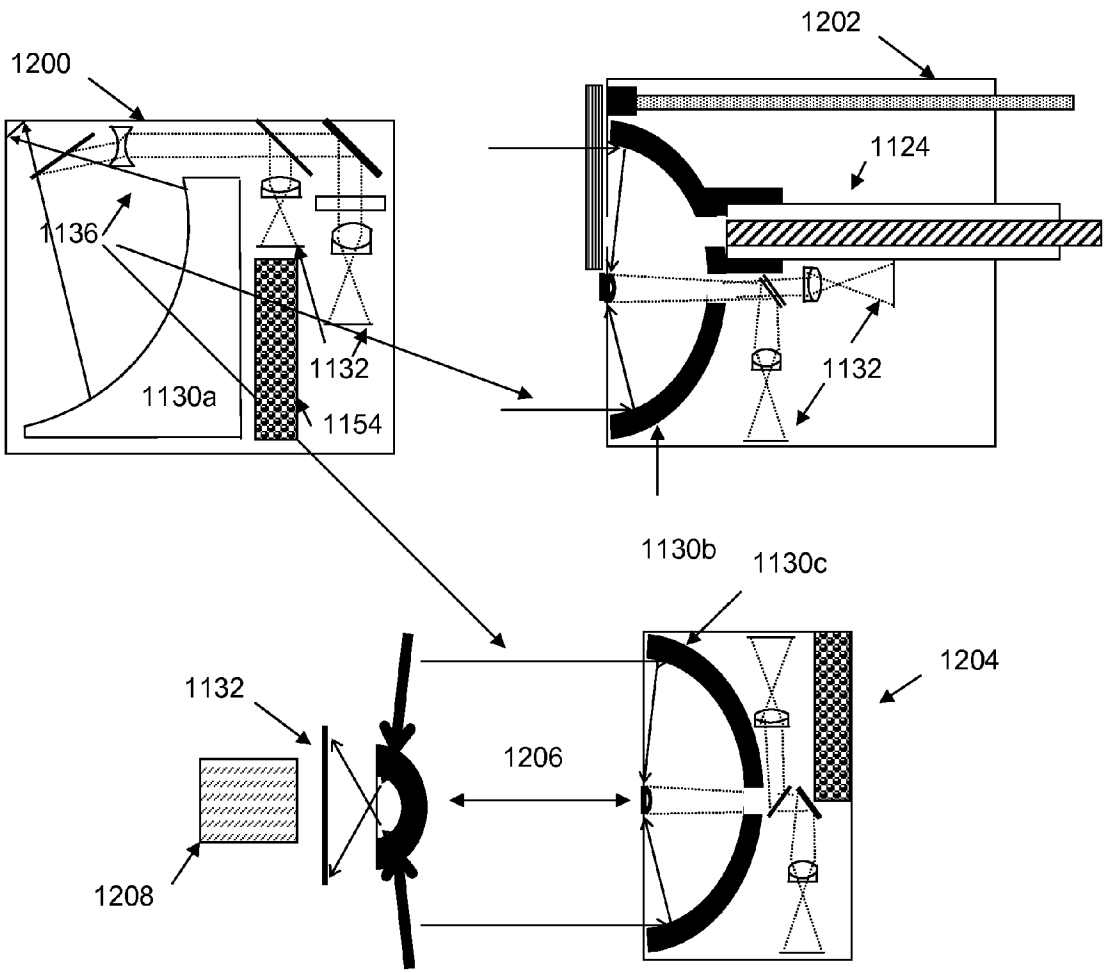
FIG. 12 shows a section side plane view of multiple electronic sensors used in conjunction with multiple optical filters and or magnifications to produce multiple electronic views or a series of zoomed views.

FIG. 11A shows a side view of an embodiment of an air rifle 1100 in which the optic train is simplified by use of a front surface aluminum reflector which may be flat (with imaging optics further down the assembly) or an off-axis primary imaging surface with minimal additional optics 1134, 1128 to form an image at the electronic sensor. FIG. 12 shows, in an embodiment of the target optic train, a parabolic short focus mirror 1130*b* with a central aperture for the beam path and an adjacent additional hole for the air gun barrel 1124. Further the sleeve assembly 1144 rotates around the grip and trigger so that the optics can be used to place the large rectangular field of view at any angle appropriate to the target, or the assembly may rotate to provide a full field of view by assembling multiple overlapping images to create a single high resolution full field image data set to present through the viewer. Rotation of assembly 1144 is illustrated in FIGS. 11B-11D, which are front views (looking down the barrel of air rifle 1100). In the example 1130*b* a four inch by two inch (50×100 mm) optic is used in conjunction with a 13 mm projectile and rifled barrel. The package is relatively compact yet it delivers a very bright wide field image with a contrast loss of only 7% with this large bore weapon.

This embodiment may have a mechanical trigger 1120 or electronic trigger 1112 and/or wireless trigger connection via password. The targeting optics 1130*a* are housed in a rotatable sleeve assembly 1144 which includes an optically transparent door 1142 which is opened by the sealed plunger 1122 whenever there is air in the propellant line 1114.

This embodiment also includes a two chamber air bottle 1102 with a bulkhead 1148 incorporating a spring and valve 1146 which puts air (or $O_2$ or other propellant gas) in the second chamber, from which it is delivered at a lower pressure to the trigger air release assembly 1118. Assembly 1102 is advantageously made from titanium, carbon fiber, diamond or other suitable lightweight material capable of holding very high gas pressures (at least 600 bar). Further this embodiment 1100 includes a spring loaded breech 1106, a pressure delivery sleeve 1116*a*, 1116*b* and a projectile magazine 1110 from which the forward return motion of the breech 1106 loads a projectile from the magazine in a manner well known in the art. The breech moves backward at a rate based on the spring constant of the return spring and the mass of the breech with respect to the projectile, and this motion backwards and forwards loads and cocks the device to be ready to fire the next round.

FIG. 12 shows various optical assemblies 1200, 1202, 1204. Optical assembly 1200 has an optical path 1136 in which multiple electronic sensors are used to filter the incoming light to optimize laser spot detection on the target along with presenting views of the target at different optical magnifications. In one embodiment (with parabolic mirror 1130*b*) the secondary reflector 1206 is partially transmitting and forms a refractive optic element (see 1130*c* and enlargement of the secondary to the left of 1130*c*), which places a very wide angle view on the sensor 1132. Further, in this latter enlarged view an acoustic sensor with directional discrimination is combined with the target optic system. FIG. 12 also shows two camera-only assemblies 1202 and 1204 which may also be used in conjunction with the air gun from any position or angle. The distance between the camera and the gun is known (e.g., both may have GPS readings), and the camera can detect the presence of a laser spot produced by the coaxial laser diode 1140 on the target and calculate time of flight to determine the distance from the air gun (and show on a display a proper hold or offset to compensate for bullet drop and/or wind effect).

Figure 13:
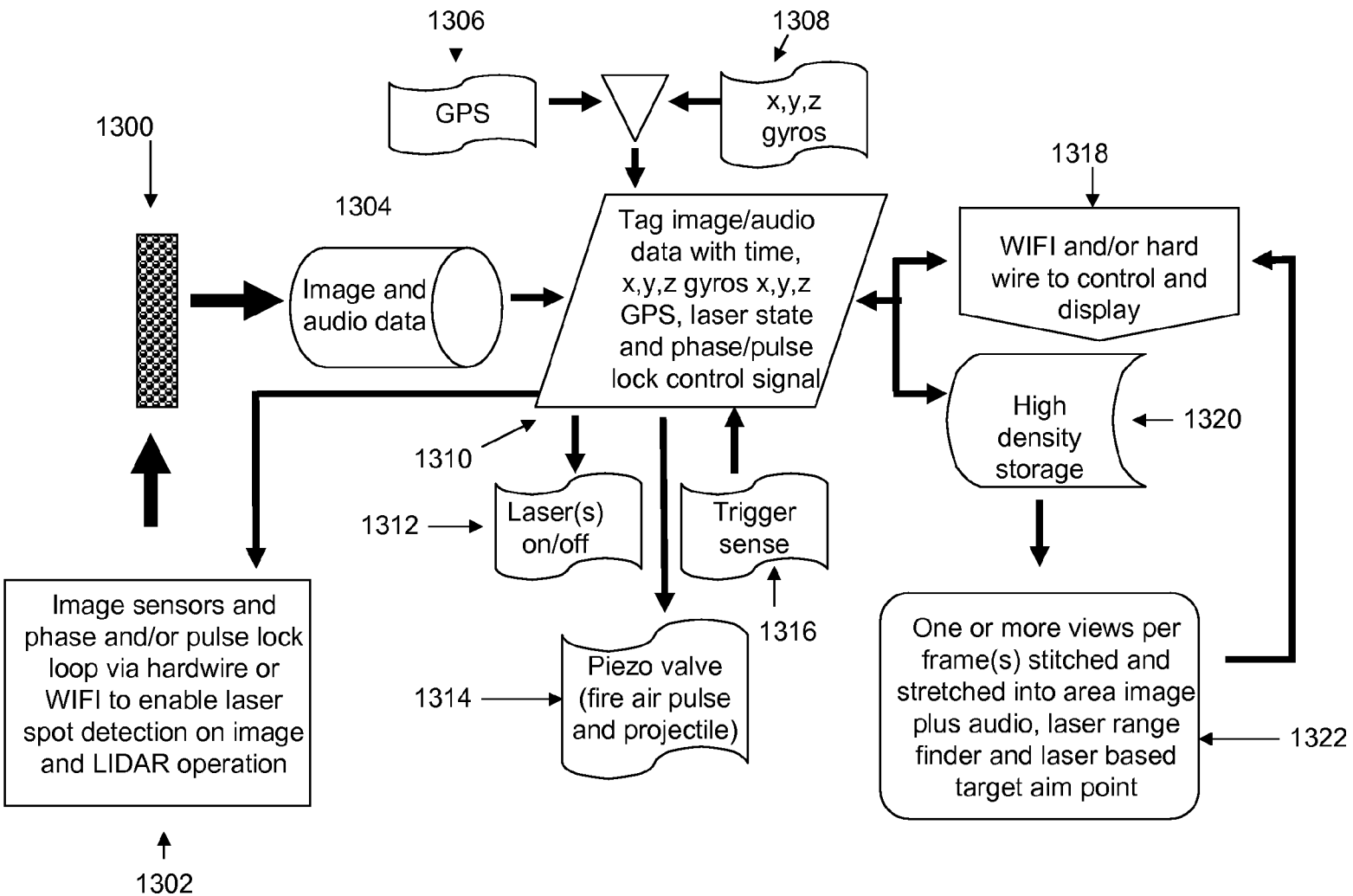
FIG. 13 shows a schematic view of the GPS sensor and local three axis gyroscopic sensors which comprise additional elements for the random image reconstruction and the precise documentation of a visual "kill" or any action which may be associated with the image recording, acoustic recordings, laser modulation by phase, pulse or intensity to form a high sensitivity for the laser spot on the target, in addition the pulse or spectral modulation permits laser range finding by timing the launch to return interval (times the speed of light in air) laser spot recordings or action of the operator.

FIG. 13 shows how the various component sensors operate in conjunction with software to reconstruct and compensate any series of images and/or acoustic records, and/or laser spot records, and/or laser spot time of flight and/or phase or pulse locking to enhance the signal to noise capabilities of the spot at the target. As indicated at 1302, image sensors and phase and/or pulse lock loop via hardware or WiFi enable laser spot detection on the image and LIDAR operation through controller 1300, thus producing image and audio data 1304. This data can be combined at 1310 with GPS data 1306 and/or (x, y, z) gyroscopic data 1308, thus allowing the image/audio data to be tagged with (x, y, z) from the gyros or GPS, laser state and phase/pulse lock control signals. Other signals such as laser on/off 1312 and trigger sense 1316 can be combined at 1310 as well, resulting in operation of a piezo valve at 1314 to fire an air pulse and the projectile.

It should be noted that because of the signal to noise reduction, the pixel or electronic sensor element that detects the spot may be as much as 1000 times larger then the laser spot and/or operator actions (firing the weapon, initiating a single image shot, a series of shots [film], an acoustic recording, an electronic annotation or acoustic [voice] annotation). In this fashion in an effort similar to that presently used by trout fisherman, a hunter may "catch and release" a quarry with a clear recording of the quarry and the laser spot on a kill zone of the quarry WITHOUT ACTUALLY HARMING THE TARGET ANIMAL. This method also supplements those described above by using a random series of photos and/or acoustic records in conjunction with a precise (nearest 10 microns) knowledge of the relative (x,y,z) position of each photo or acoustic record to sew together or recreate a large area high resolution optical and/or acoustic image.

Additionally, as shown in FIG. 13, the components of the weapon may be operated by use of remote connections, such as radio-frequency or secure Wi-Fi (e.g., IEEE 802.11a, 802.11b, etc.) wireless connections 1318. The connections may be remote from the device or local and/or attached to the device. Through these connections, one or more views per frame can be stitched and stretched into an area image plus audio, laser range finder, and laser-based target aim point 1322; high density storage 1320 allows storage of such images.

While the invention has been described with respect to specific embodiments, one skilled in the art will recognize that numerous modifications are possible. One skilled in the art will also realize that the invention provides a number of advantageous techniques, tools and products, usable individually or in various combinations. These techniques, tools and products include but are not limited to:

- a compressed gas projectile launcher in which the initial gas launch is mechanical and is combined with an electric valve to complete the launch cycle; and/or
- a compressed gas projectile launcher in which the initial and subsequent gas releases are controlled by an electric valve; and/or
- a projectile device in which pressure, projectile velocity, sound pitch of the projectile, sound pitch of the projectile launch tube as the air column in the tube changes, or a LIDAR reading of the velocity of the projectile, or gas escaping from the device is used to regulate the gas release to obtain a particular projectile velocity or pattern of velocities; and/or
- a projectile that has a provision for passing light through its center; and/or
- a projectile that is shaped as a polygon and has spin imparted by matching polygonal spiral in the launch tube or barrel; and/or
- a projectile in which a central cavity contains a fuel which can combine with oxygen from the compressed gas and/or atmosphere to form a ramjet to accelerate the projectile; and/or
- a projectile in which a central cavity contains a transparent or opaque material which ignites and burns at a controlled rate under the influence of high pressure air, or oxygen; and/or
- a projectile in which a central cavity contains a transparent or opaque material which ignites and burns at a controlled rate under the influence of a electromagnetic radiation source in the presence of high pressure air, or oxygen; and/or
- a projectile in which a central cavity contains a transparent or opaque material which ignites and burns at a controlled rate under the influence of a electromagnetic radiation source; and/or
- a light source that projects one or more collimated beams of electromagnetic energy through the transparent center of a projectile and that is mounted on or in the pressure valve or rear of the barrel/launch tube and behind the projectile; and/or
- a laser light source that projects one or more collimated beams of electromagnetic energy through the transparent center of a projectile and that is mounted on or in the pressure valve or rear of the barrel/launch tube and behind the projectile; and/or
- a quantum dot light source that projects one or more collimated beams of electromagnetic energy through the transparent center of a projectile and that is mounted on or in the pressure valve or rear of the barrel/launch tube and behind the projectile; and/or a projectile device having a telescopic lens with a central hole to pass the projectile, and an imaging optical system and electronic image sensor, and wired or wireless communication module to transmit the image to a viewing screen located conveniently to the operator; and/or a projectile device as above in which a wired or wireless trigger means is used to fire or initiate the gas discharge; and/or a sight display built into glasses (which may be any of protective, prescription, communications, or sunlight shading types) with integral display of one or more sight pictures from one or more projectile launching guns; and/or a projectile device as above in which the electric pressure valve, trigger, sight display, light beam, and projectile internal and external ballistic means are controlled by wireless connections; and/or a gas projectile gun in which the working compressed gas is oxygen or some mixture which is safe, non corrosive and suitable for high pressure gas guns; and/or a projectile for a gas launcher or conventional firearm in which the projectile body is made from any of bismuth, gold, silver, tungsten, osmium, platinum, rhenium, iridium, tungsten iron nickel; and/or a projectile in which an element is embossed by rifling and given a spin for stabilization in which this element (e.g., ring or disk) may be removed and replaced; and/or a reusable or one time projectile in which a special restraining or killing means is attached to the projectile; and/or a reusable or one time projectile in which a self-contained electric shocking device is attached to the projectile; and/or a reusable or one time projectile in which an arrow head is attached to the projectile; and/or a reusable or one time projectile including an explosive or inertial force device including projectiles packed around one or more secondary projectiles which release on impact; and/or a projectile for use in a gas powered launcher or gun in which a narrow tube is passed down the center line of the projectile and includes a cross hole at the projectile front such the gas pressure causes a leak which blows the tube as any whistle would for internal ballistics and a different tone once the projectile leaves the barrel or launcher for the external ballistics; and/or a projectile for use in a gas powered launcher or firearm which is made by casting or molding a material loaded with spheres of one or more sizes made from bismuth, gold, silver, tungsten, platinum, osmium, iridium, rhenium, and tungsten iron nickel or any combination thereof; and/or any of the above projectile launching devices in which there is a coaxial and/or nearly coaxial optic, which may be circular or non-circular; and/or any of the above projectile launching devices in which the coaxial optic is a mirror including an image forming mirror or a simple flat front surface mirror reflecting the gathered light to an optical system in a region away the projectile path; and/or a projectile launching device in which a non circular targeting optic is in whole or in part rotatable about the aim axis;

a projectile launching device in which multiple image data sets obtained from rotating the targeting optics in whole or in part are assembled by any means into a single data set for use or presentation to the operator; and/or an electronic optical system in which image data is obtained simultaneously at different optical magnifications, or by filtering in polarization and or spectral components by two or more electronic sensors deployed along the optical paths; and/or an electronic optical system similar to the above in which position (x,y,z) and time information is used to construct any combined image using two or more images; and/or a system as above in which x,y,z and time information along with acoustic information is used to construct a compound acoustic record; and/or an electronic optical system in which verbal or keyboard information is used to annotate a sequence of images, acoustic records or actions of the operator of any kind; and/or such electronic optical systems combined to conduct a game or practice of hunting; and/or any secondary mirror reflecting lens optic in which the secondary mirror returns a partial amount of light through the central optic hole for further optical, detector or analytical interactions or image formation, while acting as a refracting optic for the transmitted light; and/or a secondary mirror system in which the image formed behind the secondary is a wide field image; and/or a device with a secondary mirror system in which a directional microphone is incorporated into the rear of the secondary after the optical path and sensor (detector); and/or a targeting system in which the laser target spot is modulated in time and or wavelength or both to produce a pattern that is used to control an amplifier to improve the signal to noise of the spot detection; and/or a targeting system in which the modulation in time and or wavelength in conjunction with an accurate clock provides flight distance of the laser spot to the target and back to the optical imaging/detection system; and/or a targeting system in which two or more laser spots are used with one being sent at a small angle with respect to the central axis of the barrel so as to offset downrange at known separations sensed by the imaging system and corresponding to known distances from the barrel end; and/or a projectile system in which a UV source is used to initiate a chemical reaction between a fuel and an oxidizer; and/or a projectile system in which an electric discharge is used to initiate a chemical reaction between a fuel and an oxidizer; and/or a projectile system in which a dual gas pressure source is used to provide high capacity and controllable and meterable pressures for projectile launch; and/or a projectile system in which the projectile includes steering means to guide it in flight; and/or a projectile system in which the projectile includes a camera to provide visual information to internal or external automation or observers; and/or a projectile system in which the camera system is a line camera scanned by the stabilizing spin imparted on the projectile at launch; and/or a target imaging or other imaging system in which two or more images are formed at different variable or fixed optical magnifications from the same primary optical lens or mirror and which are combined in any way to create a zoom image or overall image by a combination of optical and electronic pan and zoom; and/or a small arms projectile system which use digital communications and imaging to control access and acquire targets; and/or an air dropped projectile system which launches a projectile which can collect image data after launch.

While the above is a complete description of specific embodiments of the invention, the above description should not be taken as limiting the scope of the invention as defined by the claims.

What is claimed is:

1. An optical system for a projectile launching device, said optical system including:

a first optical element adapted to receive light and having an optical axis, the first optical element being mountable on a barrel of a projectile launching device such that the optical axis of the first optical element is disposed coaxially with, or parallel with an axis that is coaxial with, an axis of the barrel of the projectile launching device; and an imaging system adapted to generate image data based on light received by the first optical element;

wherein the first optical element is formed with an aperture surrounding the axis of the barrel and sized to allow passage of a projectile being launched by the projectile launching device.

2. The optical system of claim 1 further comprising:

a second optical element disposed in a region away from a path of a projectile launched by the projectile launching device, wherein the first optical element comprises a mirror that reflects light to the second optical element.

3. The optical system of claim 1 wherein the imaging system is adapted to generate a single set of image data based on multiple images provided by the first optical element during rotation thereof.

4. The optical system of claim 1 further comprising:

a directional microphone adapted to detect a sound emitted from the projectile and to generate acoustic data, wherein the imaging system is further adapted to use the acoustic data in combination with the light received by the first optical element to construct a compound acoustic record.

5. The optical system of claim 1 wherein the optical axis of the first optical element is substantially coaxial with the axis of the barrel.

6. The optical system of claim 1 wherein the optical axis of the first optical element is displaced from, but parallel with, the axis of the barrel.

7. The optical system of claim 6 wherein the first optical element is formed with an additional aperture surrounding the optical axis.

8. The optical system of claim 1 further comprising an optical source for providing a beam that travels down the barrel and through the aperture.

9. An optical system for a projectile launching device, said optical system including:

a first optical element adapted to receive light and having an optical axis, the first optical element being mountable on a barrel of a projectile launching device such that the optical axis of the first optical element is disposed coaxially with, or parallel with an axis that is coaxial with, an axis of the barrel of the projectile launching device;

an imaging system adapted to generate image data based on light received by the first optical element;

wherein the first optical element is non circular and is rotatable relative to the barrel about an axis defining a path of a projectile through the projectile launching device; and wherein the first optical element is formed with an aperture surrounding the axis of the barrel and sized to allow passage of a projectile being launched by the projectile launching device.

10. The optical system of claim 9 wherein the imaging system is adapted to generate a single set of image data based on multiple images provided by the first optical element during rotation thereof.

11. The optical system of claim 9 further comprising:

a second optical element disposed in a region away from a path of a projectile launched by the projectile launching device, wherein the first optical element comprises a mirror that reflects light to the second optical element.

12. The optical system of claim 9 further comprising:

a directional microphone adapted to detect a sound emitted from the projectile and to generate acoustic data, wherein the imaging system is further adapted to use the acoustic data in combination with the light received by the first optical element to construct a compound acoustic record.

13. The optical system of claim 9 wherein the optical axis of the first optical element is substantially coaxial with the axis of the barrel.

14. The optical system of claim 9 wherein the optical axis of the first optical element is displaced from, but parallel with, the axis of the barrel.

15. The optical system of claim 14 wherein the first optical element is formed with an additional aperture surrounding the optical axis.

16. The optical system of claim 9 further comprising an optical source for providing a beam that travels down the barrel and through the aperture.

* * * * *